US007697865B2

(12) United States Patent
Tsujimoto

(10) Patent No.: US 7,697,865 B2
(45) **Date of Patent: *Apr. 13, 2010**

(54) FRAME STRUCTURE FOR AN IMAGE FORMING DEVICE AND FRAME ASSEMBLY METHOD

(75) Inventor: Koichiro Tsujimoto, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/395,282

(22) Filed: Feb. 27, 2009

(65) Prior Publication Data

US 2009/0169243 A1 Jul. 2, 2009

Related U.S. Application Data

(63) Continuation of application No. 11/306,298, filed on Dec. 22, 2005, now Pat. No. 7,522,856.

(30) Foreign Application Priority Data

Dec. 22, 2004 (JP) ..... 2004-370940

(51) Int. Cl.
*G03G 15/00* (2006.01)

(52) U.S. Cl. ..... 399/107

(58) Field of Classification Search ..... 399/107, 399/109, 110; 347/108, 138, 152; 248/188.8, 248/188.9, 677

See application file for complete search history.

(56) References Cited

U.S. PATENT DOCUMENTS 6,975,814 B2 * 12/2005 Tsusaka et al. ..... 399/6
7,062,216 B2 * 6/2006 Nobe et al. ..... 399/391
7,466,938 B2 * 12/2008 Tokuzaki ..... 399/107

FOREIGN PATENT DOCUMENTS

JP 2002-189324 A 7/2002

* cited by examiner

*Primary Examiner*—Hoan H Tran
(74) *Attorney, Agent, or Firm*—Global IP Counselors, LLP

(57) ABSTRACT

A frame structure includes a base plate 70, and a pair of side plates 72, 73. The base plate 70 has a bottom surface 70*a*, and an attachment edge 70*b* formed by drawing the edge of the base place downward around the entire periphery of the bottom surface 70*a*. The pair of side plates 72, 73 is attached on the attachment edge 70*b* of the base plate 70, and serves to support components used by an image forming device in image formation.

10 Claims, 8 Drawing Sheets

FRAME STRUCTURE FOR AN IMAGE FORMING DEVICE AND FRAME ASSEMBLY METHOD

CROSS-REFERENCE TO RELATED APPLICATIONS

This application is a continuation application of U.S. patent application Ser. No. 11/306,298 filed on Dec. 22, 2005, which was allowed Dec. 2, 2008. The entire disclosure of U.S. patent application Ser. No. 11/306,298 is hereby incorporated herein by reference.

BACKGROUND OF THE INVENTION

1. Field of the Invention

The present invention relates to a frame structure for an image forming device and frame assembly method.

2. Background Information

An image forming device such as a copying machine or printer is equipped with a photosensitive drum, a developing unit that includes a developer, a transfer unit that includes a transfer belt and so forth, a fusing unit that includes a fusing device, and a feeding unit for feeding paper. Each of these units is supported by a frame consisting of a base plate attached to the bottom of the device and a pair of side plates fixed to the base plate.

A conventional frame structure for an image forming device is disclosed in Japanese laid open patent publication 2002-189324. This frame has a base plate, a pair of side plates fixed to the base plate with a predetermined space, and a back surface state connecting the pair of the side plates. Components for image formation, such as the photosensitive drum, are supported between the pair of side plates.

A bent portion that is bent outward on the bottom of the side plates is formed on a conventional frame structure for an image forming device as disclosed in the above publication. This bent portion abuts against the top of the base plate and the two are fixed together by screws using an electric screwdriver or the like from the top.

With this type of frame structure, an electric screwdriver cannot be used to tighten the screws when the width of the bent portion on the bottom of the side plates is narrow, and thus workability is poor. Therefore, a width of 50 mm must normally be secured in order to attach the bent portion to the side plates.

However, there is one problem, in that widening the width of the outward protrusion of the bent portion in order to attach to the side plate requires that the size of the base plate must also be increased the same amount, thereby increasing the overall size of the image forming device.

The conventional frame structure provides support by aligning a pair of side plates using knock pins or the like for alignment against the base plate, then positions the components for image formation to the pair of side plates. The pair of side plates are mutually positioned through the base plate accordingly, and measurement error is already included between the pair of side plates for the time of base plate attachment. Further, the components for image formation are supported by a pair of side plates that include attachment error in this same manner, resulting in further errors being generated at the time of attachment, and causing an accumulation of errors. For this reason, the conventional device has required significant management of assembly errors and manufacturing errors for each component.

SUMMARY OF THE INVENTION

An object of the present invention is to provide a frame structure for an image forming device that achieves a compact form.

Another object of the present invention is to provide a frame assembly method that can easily improve assembly accuracy of the components for image formation.

A further object of the present invention is to provide a frame structure having a high degree of strength with a simple structure.

A frame structure of an image forming device according to a first aspect of the present invention comprises a base plate and a pair of side plates. The base plate has a bottom surface and an attachment edge formed by bending the side edges of the bottom surface downward. The pair of side plates are attached to the attachment edge of the base plate, and serve to support each component of the image forming device used in image formation.

This frame structure forms an attachment edge formed by bending the periphery of the bottom surface downward, and the pair of side plates are attached from the side to this attachment edge. The pair of side plates can be attached to the sides of the attachment edges of the base plate. Accordingly, the base plate can be made smaller, and the overall size of the image forming device can be more compact, than compared to the conventional structure in which a bent portion is formed to attach to the bottom of a side plate. Furthermore, workability is not sacrificed when securing the side plates to the base plate.

A frame structure of an image forming device according to a second aspect of the present invention is the frame structure of the first aspect, wherein the attachment edge of the base plate is formed continuously around the entire peripheral edge of the bottom surface. This improves the strength of the base plate, in comparison to separately forming the attachment edges of the base plate.

A frame structure of the image forming device according to a third aspect of the present invention is the frame structure of the second aspect, wherein the attachment edge of the base plate is formed by drawing. The periphery of every side of the base plate is bent downward, thereby improving the strength of the base plate easily and at a low cost in comparison to connecting these by welding or the like.

A frame structure of the image forming device according to a fourth aspect of the present invention is the frame structure of the first aspect, wherein the pair of side plates each have a side surface for supporting components used by the image forming device in image formation, and a peripheral edge formed by drawing the outer edges around the entire periphery of both side surfaces outward. In this way, the strength of the side plates can be improved simply and at a low cost, in comparison to a pair of side plates formed by means of a simple flat plate, and compared to partially bending the peripheral edge.

A frame structure of the image forming device according to a fifth aspect of the present invention is the frame structure of the fourth aspect, wherein the peripheral edges of the pair of side plates have a width of 8 mm or greater. Providing the peripheral edges of the pair of side plates with a thickness of 8 mm or greater will improve the strength thereof.

A frame structure of the image forming device according to a sixth aspect of the present invention is the frame structure of the fourth aspect, wherein the pair of side plates have a plurality of rubber mounts fixed to at least one length of the peripheral edge. These rubber mounts may be attached to the bottom peripheral edge of the pair of side plates, causing these rubber mounts to abut against the surface on which the image forming device is placed.

A frame structure of the image forming device according to a seventh aspect of the present invention is the frame structure of the first aspect, wherein fixing members are further provided in order to fix the pair of side plates to the attachment edge of the base plate. The pair of side plates are fixed by fixing members, such as screws or the like, to the attachment edge of the base plate.

According to an eighth aspect of the present invention, a frame assembly method of the image forming device is a method for assembling a base plate comprising a bottom surface of an image forming device, and a pair of side plates for supporting the components of the image forming device used for image formation, and includes mutually aligning the pair of side plates with a jig, and fixing the base plate against the pair of aligned side plates.

The frame assembly method mutually aligns a pair of side plates with a jig and thereafter fixes the base plate to the pair of side plates in an aligned state. Therefore, assembly errors between the pair of side plates can be controlled, in comparison to the conventional method which fixes by aligning the pair of side plates against a base plate. Assembly errors of the components for image formation can be reduced accordingly for supporting between the pair of side plates.

The present invention as described above has the ability to achieve a compact form for an image forming device. Further, assembly accuracy of the components for image formation can easily be improved. In addition, a frame structure having high strength with a simple structure can be provided.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
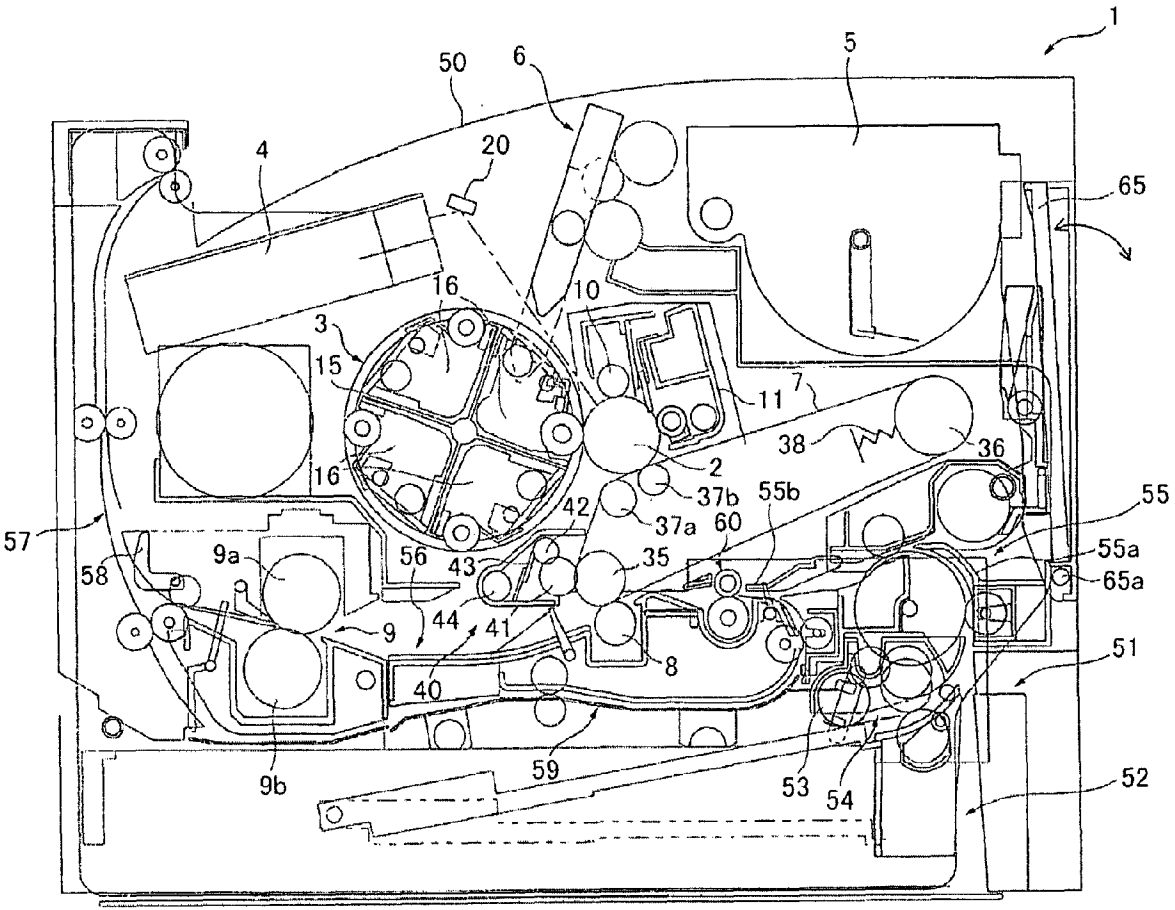
FIG. 1 shows a cross-sectional view of a color printer according to one embodiment of the present invention.

A color printer 1 is shown in FIG. 1 as an image forming device which includes a paper feed unit according to one embodiment of the present invention. FIG. 1 describes the placement of each component thereof, and the details of each component are briefly described.

Overall Construction

The color printer 1 is connected to a computer not shown in the drawing, and is a device with the ability to print color images on paper based on image information sent from the computer. The color printer 1 is operated from the right side in FIG. 1 by an operator, and the right side of the device in FIG. 1 is the front side, and the left side is the back side.

The color printer 1 has a photosensitive drum 2, a revolving development device 3, a laser unit 4 as the exposure device, a toner container 5, a toner supply device 6, an intermediate transfer belt 7, a secondary transfer roller 8, and a fusing device 9.

Photosensitive Drum

An electrostatic latent image is formed on thus surface of the photosensitive drum 2, and is rotatably arranged near the center of the device. The rotational axis of the photosensitive drum 2 is arranged to extend in the sideways direction as seen from the front of the device, that is to say, to extend in an orthogonal direction in relation to the surface of the paper of FIG. 1. A charging roller 10 for uniformly charging the surface of the photosensitive drum 2 is arranged above the photosensitive drum 2. A drum cleaning device 11 is arranged to the side of the photosensitive drum 2, and serves to clean the residual toner and other adhered material on the surface of the photosensitive drum 2.

Revolving Development Device

The revolving development device 3 develops the electrostatic latent image formed on the photosensitive drum 2 using each color of toner, and it is positioned adjacent to the photosensitive drum 2 so that its center is nearly the same height as the center of the photosensitive drum 2. The revolving development device 3 has a rotary frame 15, and a four color developer 16 supported by the rotary frame 15 and arranged corresponding to 4 colors of toner. The rotary frame 15 is a freely rotating cylinder around an axis parallel with the rotational axis of the photosensitive drum 2, and is rotated by a drive mechanism which includes a motor and gears not shown in the drawing. The rotary frame 15 has 4 compartments equally divided that radiate from the center of the rotational axis to the circumference and separated by partition walls, and the developer 16 is arranged to correspond to the four toner colors of yellow, cyan, magenta, and black.

Figure 2:
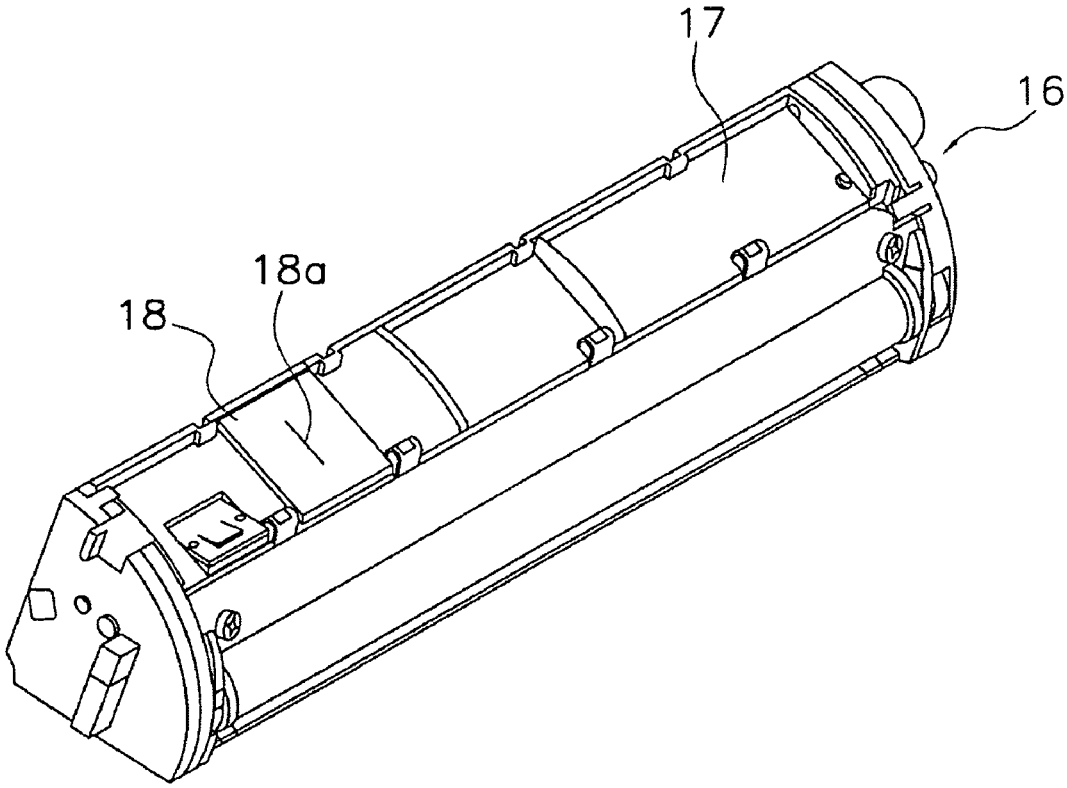
FIG. 2 is a perspective view of a developer.

Each developer 16 is constructed in a similar manner, and is equipped with a development roller that can be placed opposite the photosensitive drum 2 and an agitation roller for stirring the toner. One of the developers 16 from among the four is shown in FIG. 2. A toner container (to be described hereinafter) is arranged separately from the developers 16, and thus the space for storing toner in the developers is small in the present embodiment, and the developers 16 can be reduced in size compared to a device having a toner container within each developer. A toner supply unit 18 is provided as shown in FIG. 2 on the outer periphery of the case 17 of the developer 16, for supplying toner from the toner container to the interior of the developer 16. The toner supply unit 18 includes an opening formed in a portion of the case 17, and an elastic member in which a slit 18*a* is formed therein is fixed to the opening.

Laser Unit

The laser unit 4 is for scanning exposure of the photosensitive drum 2 based on the image information sent from the external computer, and is placed to the far side of the device (side 1) from the rotational axis of the revolving development device and above the photosensitive drum 2. More specifically, the front end of the laser unit 4 (the end of the side from which the laser beam is emitted) is positioned directly over the rotational axis of the revolving development device 3, and moving diagonally downward to the back end side, the back end is positioned lower than the top end of the revolving development device 3. Moreover, the configuration within the laser unit 4 is the same as that of a conventional unit having a laser beam source, polygon mirror, polygon mirror drive motor, and so forth. A reflective mirror 20 is provided in front of the laser beam path of the laser unit 4, and the laser beam emitted from the laser unit 4 is bent by the reflective mirror 20 and is thereby irradiated onto the surface of the photosensitive drum 2.

Toner Container

Figure 6:
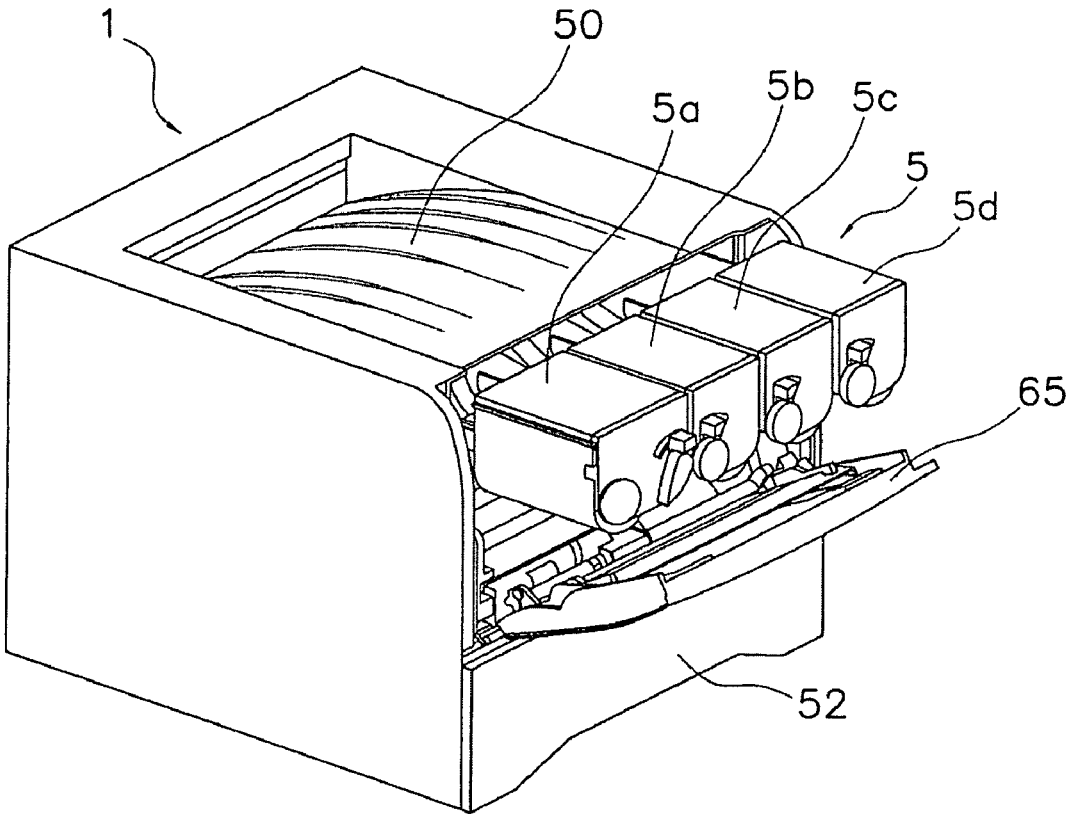
FIG. 6 is a perspective view of a color printer in which the toner supply device is partially pulled out therefrom.

The toner container 5 stores the toner to be supplied to each of the developers 16 of the revolving development device 3, and is placed on the opposite side of the laser unit 4 (device front side: side 2) above the photosensitive drum 4. The toner container 5, as shown in FIG. 6, has four containers 5*a*, 5*b*, 5*c*, 5*d* and stores each of the toner colors, yellow, cyan, magenta, and black, that are placed in order side by side (orthogonal direction to the paper surface of FIG. 1). The toner container S is removable from the front side as shown in FIG. 6.

Toner Supply Device

Figure 3:
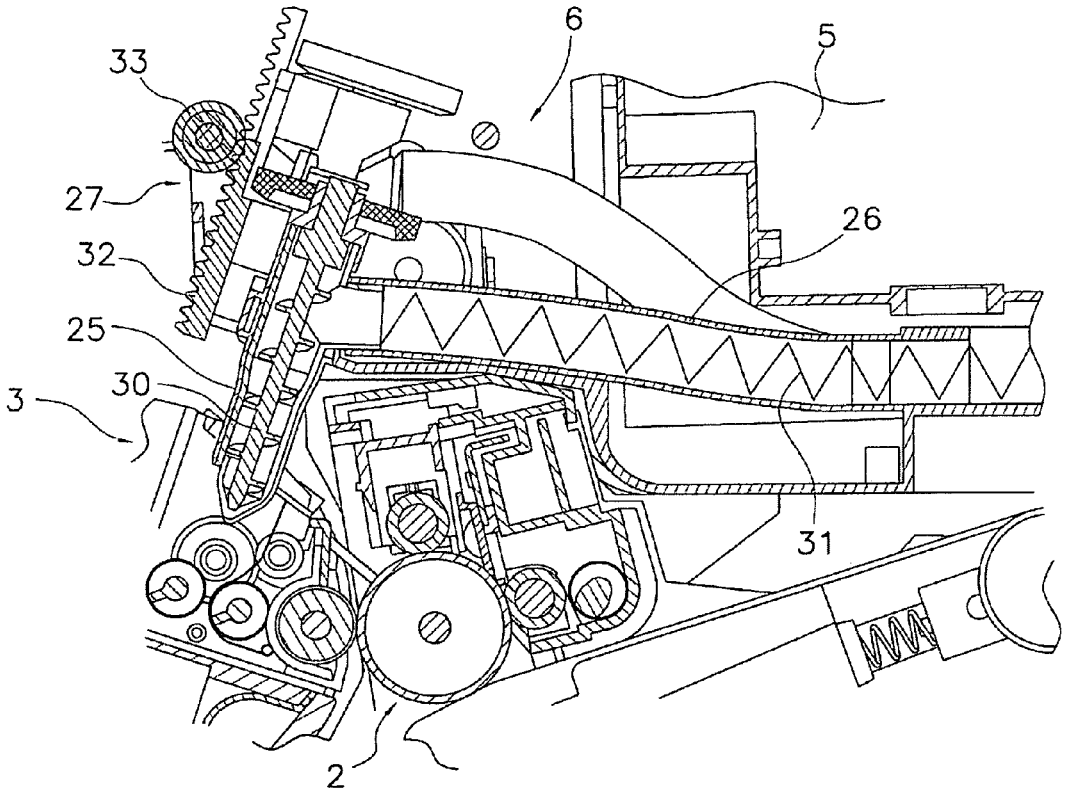
FIG. 3 is a cross-sectional view of a toner supply device.

The toner supply device 6 is for supplying each of the toner colors stored in the toner container 5 to the corresponding developer 16, and is placed in the space between the laser unit 4 and the toner container 5 above the photosensitive drum 2. The toner supply device 6, as shown in FIG. 3, has four toner supply pipes 25 capable of moving vertically, four delivery pipes 26 that connect to the toner supply pipes 25 that correspond to the portion which stores each of the toner colors in the toner container 5, and a drive mechanism 27 for vertically driving each of the toner supply pipes 25.

The toner supply pipes 25 are vertically arranged, with the top end tilted to the device front end side and the bottom end tilted to the device back end side. The toner supply pipes 25 have a tapered tip which, when moved downward, can penetrate into the toner supply unit 18 of the developer 16 through the slit 18*a*. A spiral member 30 for conveying the toner is equipped within the toner supply pipe 25 with the ability to rotate.

The delivery pipes 26 are flexible pipes capable of movement that follows the vertical movement of the toner supply pipes 25. A coil spring 31 is placed inside and is rotated by the drive mechanism not shown in the drawing thereby delivering toner to the toner supply pipes 25 by passing through the delivery pipes 26.

The drive mechanism 27 has a rack 32 equipped along the axis direction to the periphery of the toner supply pipes 25 and a pinion gear that meshes with the rack 32. The pinion gear 33 is supported by the frame of the device with the ability to freely rotate and is driven by a motor not shown in the drawing. The toner supply pipes 25 can be placed into a high retracted position, and a low supply position when the tip penetrates into the developer 16.

The toner supply pipes 25 also have a shutter mechanism that opens only when the toner supply pipes 25 are positioned in the supply position. More specifically, the toner supply pipes 25 are a two layer construction having an inner pipe and an outer pipe with an opening formed on a portion of the circumference at the tip of each of these pipes. The outer pipe is formed with a protrusion around the periphery, and this protrusion meshes with a revolving cam forming a spiral groove further placed around the periphery. When the toner supply pipes 25 are up in the retracted position, the opening of the inner pipe and the opening of the outer pipe do not match (shutter closed), and toner does not leak out. On the other hand, when the toner supply pipe 25 moves downward, the outer pipe rotates by the protrusion with the revolving cam causing the tip of a toner supply pipe 25 to penetrate into the developer 16 to be in the supply position, thereby matching the opening of the inner pipe with the opening of the outer pipe (shutter open) enabling the toner within to be supplied into the developer 16 from the opening.

Intermediate Transfer Belt

The intermediate transfer belt 7 sequentially transfers a toner image of each color formed by the photosensitive drum 2, and is placed below the photosensitive drum 2 and toner container 5. The intermediate transfer belt 7 spans between the drive roller 35 and the opposite placed driven roller 36. The portion thereof that opposes the photosensitive drum 2 of the intermediate transfer belt 7 is constructed to abut against the photosensitive drum 2 by means of a pair of primary transfer rollers 37*a* and 37*b*.

A more detailed description of the placement of these components is given hereinafter. The drive roller 35 is placed directly below the contact portion of the photosensitive drum 2 and the revolving development device 3, and the center thereof is further placed lower than the most bottom end of the revolving development device 3; and it is driven by the drive unit that includes a motor and gears not shown in the drawing. The driven roller 36 is placed near to the bottom of the device front side of the toner container 5, and placement height thereof is the same as the photosensitive drum 2. The driven roller 36 is energized by a spring 38 to the side separated from the drive roller 35, thereby applying a predetermined tension to the intermediate transfer belt. The primary transfer rollers 37*a* and 37*b* are equipped below the photosensitive drum 2 in mutual proximity, allowing a predetermined range of the transfer belt 7 to abut with the photosensitive drum 2.

A belt cleaning device 40 for cleaning the transfer belt 7 is arranged below the revolving development device 3 at the device back end of the drive roller 35. The belt cleaning device 40 has a fur brush 41 to brush the surface of the transfer belt 7 arranged in a position opposing to the drive roller 35, a cleaning roller 42 placed to contact with the fur brush 41 above the fur brush 41, a blade 43 placed so its tip makes contact with the surface of the cleaning roller 42, and a collection spiral 44 placed in order below the blade 43.

Attached material on the intermediate transfer belt 7 is scraped off by the fur brush 41 in the cleaning device 40, and the attached material scraped off by the fur brush 41 are collected by the cleaning roller 42. The attached objects collected to the cleaning roller 42 side are scraped and dropped from the surface of the cleaning roller 42 by the blade 43, and are collected into the collection unit not shown in the drawing by the collection spiral 44.

Secondary Transfer Roller

The secondary transfer roller 8 is for transferring the image transferred by the intermediate transfer belt 7 onto paper, and is positioned to oppose the drive roller 35 underneath the drive roller 35. The secondary transfer roller 8 applies a bias voltage for image transfer onto the paper by a voltage application means not shown in the drawing.

Fusing Device

The fusing device 9 is for fusing the toner that has been transferred onto the paper, and is placed to the back side of the device below the revolving development device 3. The fusing device 9 has a heating roller 9*a* with an embedded heater, and a pressure roller 9*b* that presses against the heating roller 9*a*, and paper is fed between these two rollers.

Discharge Unit

A discharge unit 50 is formed on the printer 1 on the top surface thereof, i.e. above the laser unit 4, toner supply device 6, and toner container 5, and serves to hold documents that have been printed by the printer 1. The discharge unit 50 has a curved portion that gradually rises from the lowest laser unit 4 side (device back side) while progressing to the toner container 5 side (device front side), and a flat portion positioned above the toner container 5 connecting to the curved portion.

Paper Supply Cassette and Paper Feeding Unit

Figure 5:
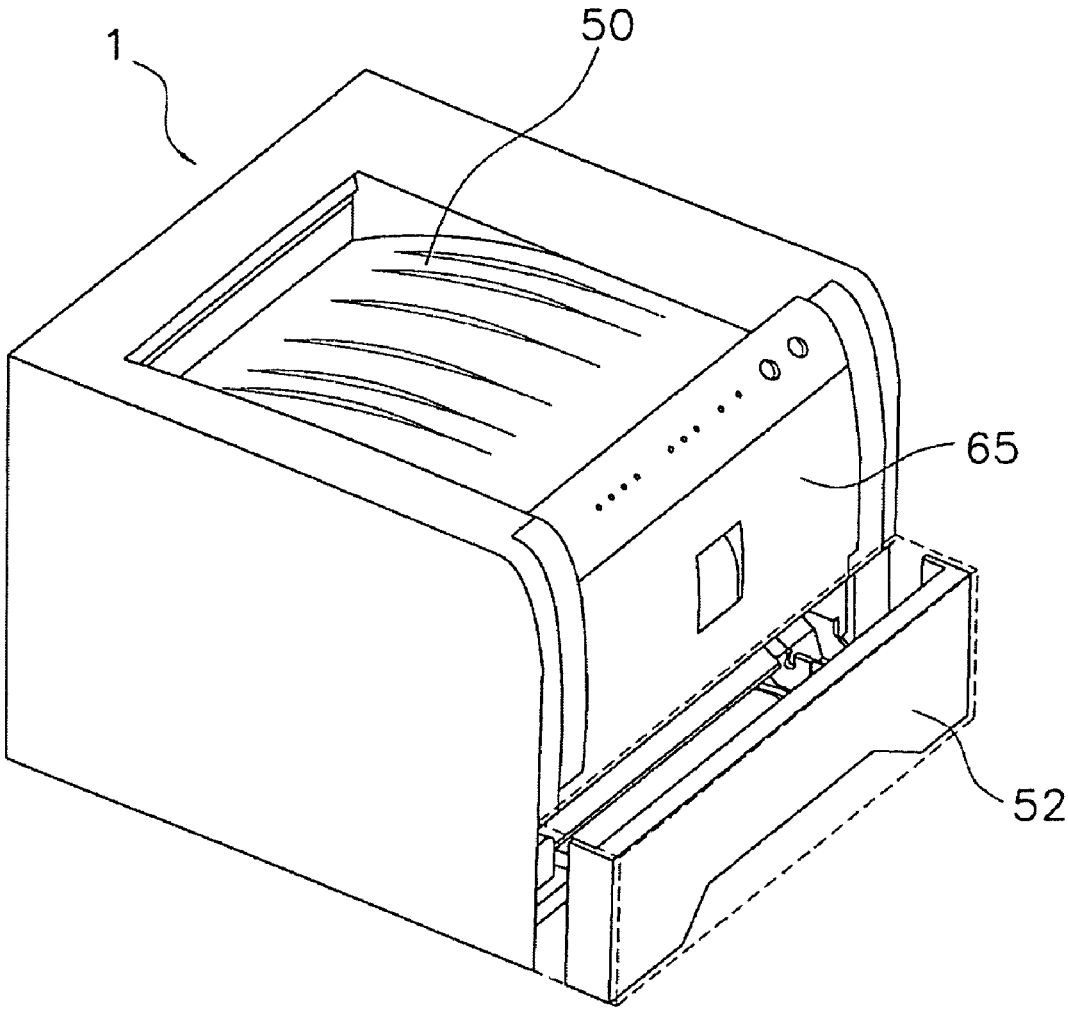
FIG. 5 is a perspective view of a color printer in which a paper supply cassette is partially pulled out therefrom.

A paper supply cassette 52 having a loading tray where paper is loaded is arranged at the bottom of the device, and serves to store paper. A paper supply unit (paper delivery unit) 51 is arranged at the end of the paper delivery side (end of right side in FIG. 1) of the paper supply cassette 52 for delivering paper from the paper supply cassette 52. The paper supply unit 51 has a forward delivery roller 53 for delivering the paper on the loading tray, and a multi-feed prevention mechanism 54 comprising a roller pair for delivering one sheet of paper at a time onto the feed path. The paper supply cassette 52, as shown in FIG. 5, is capable of being pulled in to the transfer direction of the paper, i.e. the front side of the device.

A feeding unit is equipped between the paper supply unit 51 and the discharge unit 50, and serves to feed paper. The feeding unit has a first feed path 55 spanning from the paper supply unit 51 to the secondary transfer roller 8, a second feed path 56 spanning from the secondary transfer roller 8 to the fusing device 9, and a third feed path 57 spanning from the fusing device 9 to the discharge unit 50. A branching claw 58 is further equipped at the exit of the fusing device 9, and a return feed path 59 is equipped between the branching claw 58 and part way through the first feed path 55 to return paper to the first feed path 55.

The first feed path 55 has a curved path 55*a* for reversing the feed direction while feeding the paper delivered from the paper supply cassette 52 upward, and a direct path 55*b* spanning from the curved path 55*a* to the secondary transfer roller 8. These feed paths are formed from guide plates and roller pairs for guiding the paper, and equip sensors in predetermined positions for detecting paper. A resist roller pair 60 is further arranged in the direct path 55*b* to control the feed timing of the paper.

The second feed path 56 is formed in nearly a straight line and is formed from a guide plate and a roller pair for guiding and feeding paper. A sensor is equipped at a predetermined position on the feed path to detect paper.

The third feed path 57 has a vertical feed path formed at the down stream side in the feed direction of the branching claw 58. In other words, the paper is fed in nearly a vertical direction after passing through the branching claw where it is discharged to the discharge unit 50. The third feed path 57 is also constructed of a guide plate and roller pair to guide and feed paper in the same manner.

The return feed path 59 is a feed path that branches downward from the third feed path 57 in that part where the branching claw 58 is equipped below the fusing device 9, the second feed path 56, the secondary transfer roller 8, and the resist roller pair 60 before once again facing upwards, and merges with the feed direction of the up stream side of the resist roller pair 60 of the first feed path 55. In other words, the return feed path 59 is equipped between the upward direction of the paper supply cassette 52 and the second feed path 56 and the direct path 55*b* of the first feed path 55, and it is a feed path for returning paper that passes through the fusing device 9 once again to the up stream side of the resist roller pair 60 placed to the up stream side of the secondary transfer roller 8. This return feed path 59 is also constructed from a guide plate and roller pair for guiding and feeding paper, and is equipped in a predetermined position with a sensor for detecting paper.

Figure 7:
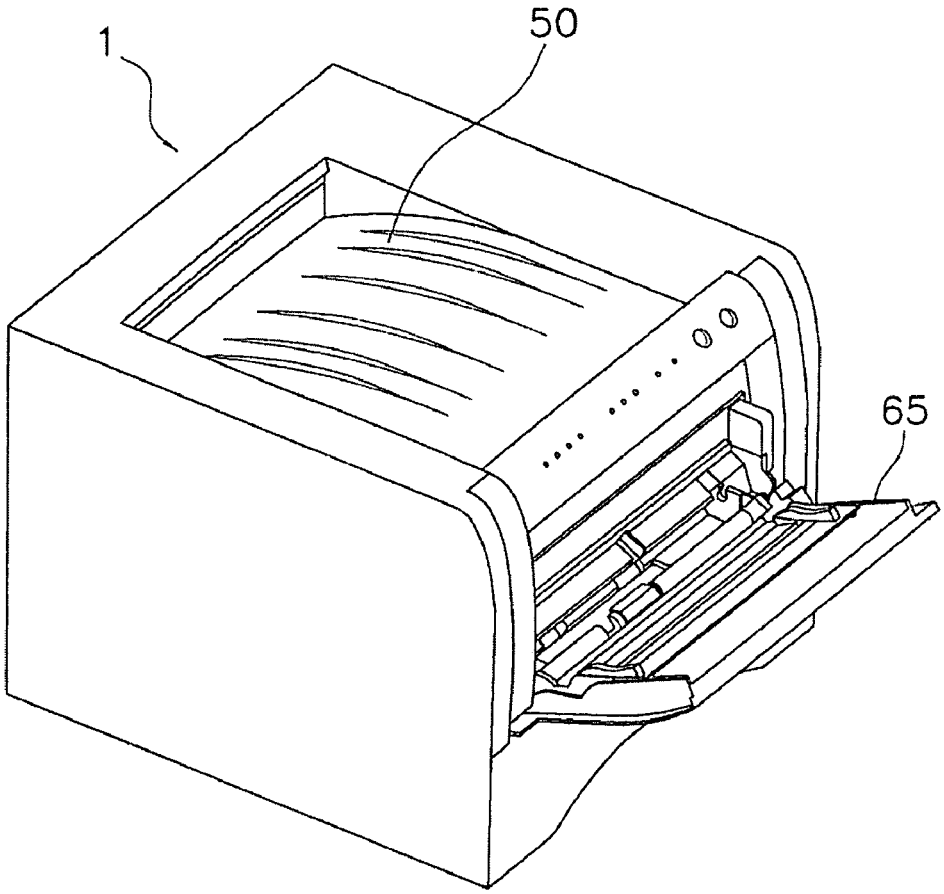
FIG. 7 is a perspective view of a color printer in which a manual feed tray is in the open state.

A manual feed tray 65 is placed so as to form a side wall at the front end of the device above the paper supply cassette 52 and below the toner container 5. The manual feed tray 65 is supported at the bottom with the ability to freely rotate (open and close freely) in the vicinity of the curved path 55*a* of the first feed path 55, and as shown in FIG. 6 and FIG. 7), the top is capable of collapsing to the front side of the device centrally around a movable support point 65*a*. When paper is placed onto the manual feed tray 65 when the manual feed tray 65 is open, the paper can be supplied to the curved path 55*a* of the first feed path 55.

Figure 8:
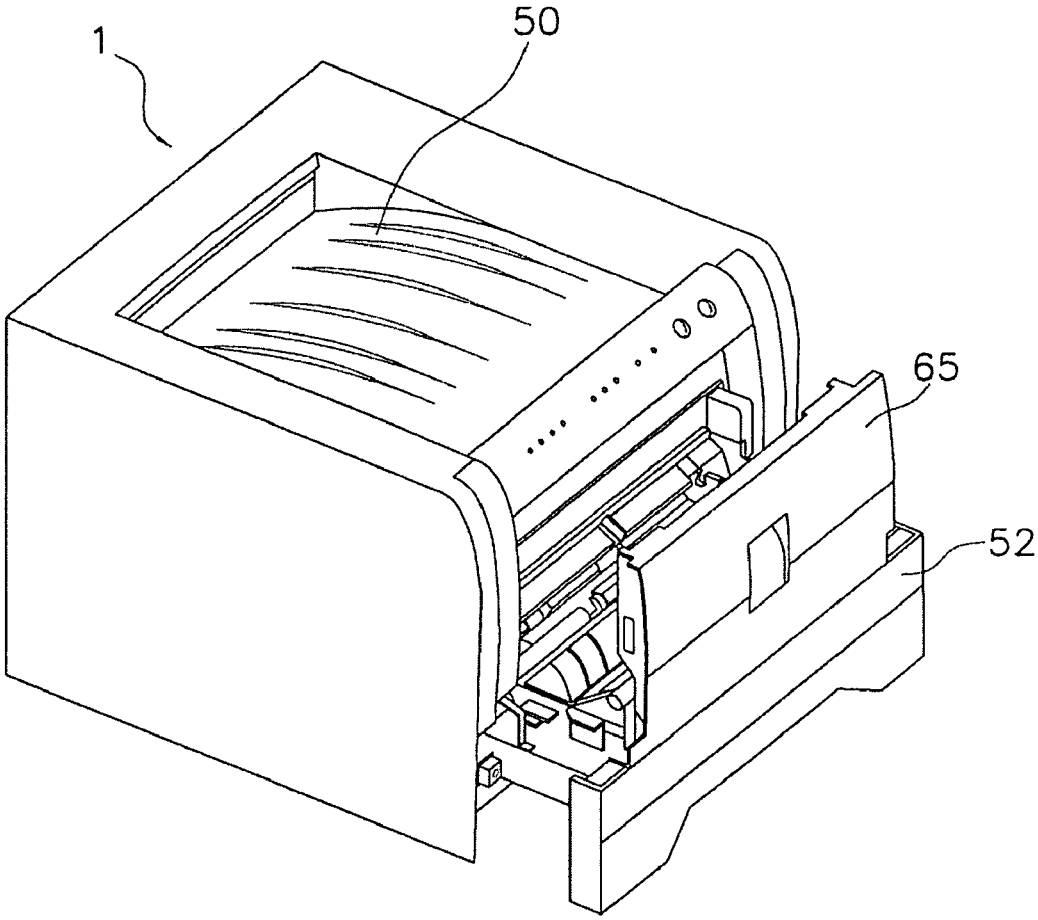
FIG. 8 is a perspective view of a color printer in which a paper feed unit is partially pulled out therefrom.

A feeding unit that feeds paper in this manner combines the paper supply cassette 52, first feed path 55, second feed path 56, return feed path 59, and the manual feed tray 65 into a single unit. This paper feeding unit, shown in FIG. 8, has the ability to draw to the device front side along the paper delivery direction and the paper feed direction.

Frame Structure

Figure 4:
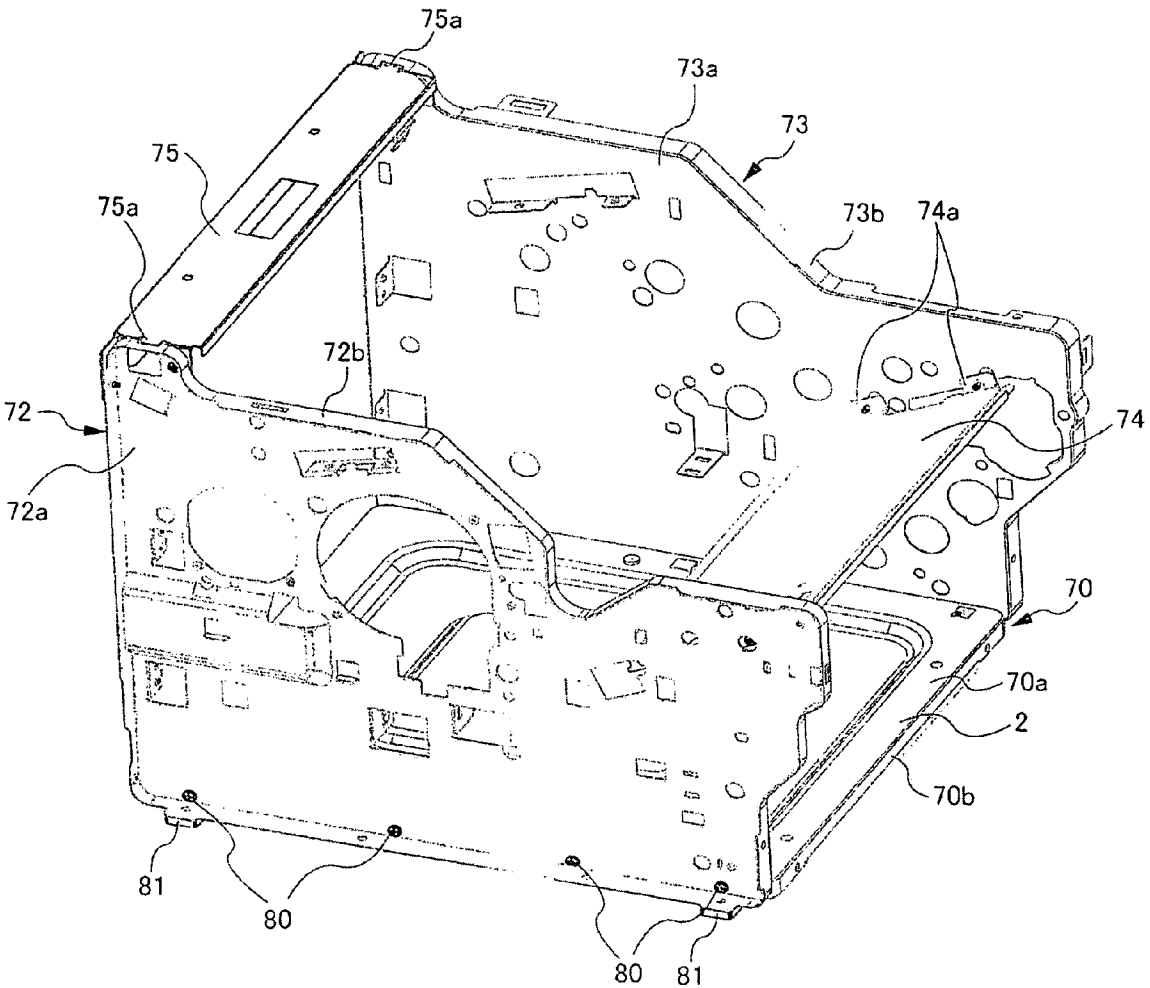
FIG. 4 is a perspective view of a frame structure.

A description will be given with reference to FIG. 4 of the frame structure for supporting each component used in image formation in this manner. The frame of the printer has a base plate 70 attached to the bottom of the device, a pair of side plates 72, 73 attached to the left and right of the base plate 70, and front and rear stays 74, 75 attached between the pair of side plates 72, 73.

The base plate 70 is formed of a metal plate and has a bottom surface 70*a* with an opening formed in the center, and an attachment edge 70*b* formed by bending downward the entire peripheral edge of the bottom surface 70*a*. The attachment edge 70*b* is formed by drawing the bottom surface downward, and continues around the entire periphery. A plurality of threaded through holes are formed in the attachment edge 70*b*.

The pair of side plates 72, 73 are metal plates which serve to support components used in image formation, and are fixed by a plurality of screws 80 to the attachment edge 70*b* of the base plate 70. The pair of side plates 72, 73 have side surfaces 72*a*, 73*a* which support components used for image formation, and peripheral edges 72*b*, 73*b* formed by drawing the entire peripheral edge of the side surfaces 72*a*, 73*a* outward. The peripheral edges 72*b*, 73*b* are formed continuously around the entire periphery of each side plate 72, 73, and a width of 8 mm or greater is preferred in consideration of rigidity. A plurality of rubber mounts 81 are attached respectively to the bottom surface of the attachment edges 72*b*, 73*b* of each side plate 72, 73. By placing these rubber mounts 81 in contact with the surface in which the printer 1 is placed, the base plate 70 will not contact with that surface. Moreover, screw holes are formed in the bottom side of each of the side surfaces 72*a*, 73*a* in order to insert screws into the positions that correspond to the internal threads formed in the attachment edge 70*b* of the base plate 70.

The front and rear stays 74, 75 are formed from a metal plate in the same manner as the base plate 70 and the side plates 72, 73, and are installed between the pair of side plates 72, 73 to maintain the overall rigidity of the frame. The front stay 74 is placed to the front side of the device on the pair of side plates 72, 73. Bent units 74*a* bent upwards are formed to both ends of the front stay 74, and the bent units 74*a* are fixed to each side plate 72, 73 by screws. The rear stay 75 is placed at the top end of the side plate at the ends of the back side of the device. Bent portions 75*a* that are bent downwards are formed on both ends of the rear stay 75, and the bent portions 75*a* are inserted into the slots formed in the peripheral edges 72*b*, 73*b* of each side plate 72, 73.

Image Forming Operation

A brief description will be given hereinafter of the image forming operation. When power is applied to the color printer, various parameters are first initialized, thereby executing initial settings such as temperature settings of the fusing unit. Image data is input from a computer or the like connected to this printer, and image forming operation as described below is executed when an instruction to initiate printing is given. Moreover, the toner supply pipes 25 are moved upward to a sheltered position in the process of the image forming operation.

The photosensitive drum 2 is charged by the charging roller 10. Thereafter, the photosensitive drum 2 is exposed to the corresponding image information scanned by the laser unit 4 in order to form an electrostatic latent image on the photosensitive drum 2. Next, the revolving development device 3 is rotated so that the developing apparatus 16 for the corresponding color faces the photosensitive drum 2. In this state, the electrostatic latent image of the photosensitive drum 2 is developed by the toner of the corresponding color. The developed image is transferred to the intermediate transfer belt 7. The full color image is formed on the intermediate transfer belt 7 by repeating this operation in order for each color. Moreover, the residual toner that remains on the photosensitive drum 2 is cleaned by the drum cleaning device 11 and discarded in the discard toner container not shown in the drawing.

At the paper supply unit 51, a single sheet of paper from the paper supply cassette 52 is extracted by the forward delivery roller 53 and the multi-feed prevention mechanism 54, and fed to the resist roller pair 60 through the first feed path 55. Thereafter, the paper is fed from the resist roller pair 60 to match the image formation timing on the intermediate transfer belt 7, and then guided to the secondary transfer roller 8. The secondary transfer roller 8 connects with the intermediate transfer belt 7, and the full color image formed on the intermediate transfer belt 7 is transferred to the paper by the transfer bias applied to the secondary transfer roller 8. The paper is guided to the fusing device 9 through the second feed path 56, where the image is fused to the paper by the heat and pressure applied by the fusing device 9. If printing on a single side, it is guided to the third feed path 57 through the branching claw 58 and discharged at the discharge unit 50.

If printing on both sides, the paper which passed through the fusing device 9, is fed once to the third feed path 57 by the branching claw 58 and after the back end of the paper passes the branching claw 58, it is fed in reverse order and guided to the return feed path 59 where it is returned once again to the first feed path 55 via the return feed path 59. Paper which is returned to the first feed path 55 is temporarily stopped at the resist roller pair 60. Then, after the image for the reverse side is formed at the intermediate transfer belt 7 through the same operation as that described above, the paper standing-by at the resist roller pair 60 is sent to the secondary transfer roller 8 at a synchronized timing. Thereafter, the same operation as described above is executed, where it is guided to the third feed path 57 through the branching claw 58 and discharged at the discharge unit 50.

Toner Supply Operation

When supplying toner to the developer 16, the toner supply pipes 25 are moved downward and placed in a supply position. In other words, the toner supply pipes 25 fixed to the rack 32 move downward by the rotation of the pinion gear 33 via gears through the drive of the motor not shown in the drawing. Meanwhile, toner is supplied from the toner container 5 via the delivery pipes 26 to the toner supply pipe 25 side. The tip of the toner supply pipe 25 is inserted into the developer 16 through the slit 18*a* as the toner supply opening. When the toner supply pipes 25 moves downward, the outer pipe constructed of the toner supply pipe 25 revolves against the inner pipe so that the opening of the outer pipe matches with the opening of the inner pipe at the point when the tip of the toner supply pipe 25 is inserted into the developer 16. In other words, the shutter mechanism opens allowing toner within the toner supply pipe 25 to be supplied to the inside of the developer 16.

Moreover, when the toner supply pipe 25 is positioned in the supply position, the toner supply pipe 25 shields the optical path from the laser unit 4 to the photosensitive drum 2. However, this is not a problem as the toner supply operation by the toner supply pipe 25 and the image formation operation do not occur at the same time.

Frame Assembly Method

Next, a description will be given of the frame assembly method of the present invention. When assembling the frame, i.e., the base plate 70, the pair of side plates 72, 73, and the front and rear stays 74, 75, the pair of side plates 72, 73 are first stood up, a jig (not shown in the drawing) is inserted there between for alignment, and the pair of side plates 72, 73 are aligned using the jig. The base plate 70 is inserted between the pair of side plates 72, 73 while in an aligned state. The screws 80 are inserted into the holes formed in each of the side plates 72, 73 from the side of each side plate 72, 73 and screwed into the internal threads formed in the attachment edge 70*b* of the base plate 70. Thereafter, the front and rear stays 74, 75 are fixed between the pair of side plates 72, 73.

Because the pair of side plates 72, 73 are attached to the attachment edge 70*b* of the base plate 70 from the side, the base plate 70 can be smaller and thereby provide a more compact device overall as compared to the conventional construction. Further, the workability at the time of frame assembly is not sacrificed.

The attachment edge 70*b* continuing around the entire periphery of the base plate 70, and peripheral edges 72*b* and 73*b* on the side plates 72, 73, are respectively formed on the attachment edge 70*b* of the base plate 70 and to each side plate 72, 73. Therefore, the rigidity of the base plate 70 and each of the side plates 72, 73 can be increased to achieve a frame structure with high rigidity. Further, since each edge is formed by drawing, each edge can be formed easily and at a low cost.

Because the pair of side plates 72, 73 are mutually aligned by a jig in the frame assembly and thereafter the base plate 70 is fixed to the side plates 72, 73 while the pair of side plates 72, 73 are in an aligned state, assembly errors between the pair of side plates can be suppressed, thereby reducing the assembly errors of the components used for image formation that are supported between the pair of side plates 72, 73.

Alternate Embodiment

The embodiment given above formed the attachment edge of the base plate by drawing, but the peripheral edge of each edge of the base plate may also be bent and worked downward, and a continuous edge can then be formed by welding each bent portion.

Any terms of degree used herein, such as "substantially", "about" and "approximately", mean a reasonable amount of deviation of the modified term such that the end result is not significantly changed. These terms should be construed as including a deviation of at least ±5% of the modified term if this deviation would not negate the meaning of the word it modifies.

This application claims priority to Japanese Patent Application No. 2004-370940. The entire disclosure of Japanese Patent Application No. 2004-370940 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention is provided for illustration only, and not for the purpose of limiting the invention as defined by the appended claims and their equivalents.

What is claimed is:

1. A frame structure for an image forming device, comprising:

a bottom plate having a bottom surface;

an attachment edge being bent from the edges of the bottom surface; and a pair of side plates being attached to the attachment edge of the bottom plate, the pair of side plates respectively supporting components of the image forming device used for image formation, the pair of side plates having a plurality of mounts fixed to at least one length of the peripheral edge.

2. A frame structure for an image forming device according to claim 1, wherein the attachment edge of the bottom plate is continuously formed around the entire peripheral edge of the bottom surface.

3. A frame structure for an image forming device according to claim 2, wherein the attachment edge of the bottom plate is drawn from the edges of the bottom surface.

4. A frame structure for an image forming device according to claim 1, wherein the pair of side plates each have a side surface which supports components used by the image forming device for image formation, and a peripheral edge that is drawn outward from the edge of the entire periphery of the side surface.

5. A frame structure for an image forming device according to claim 4, wherein the peripheral edge of each side plate has a width of 8 mm or greater.

6. A frame structure for an image forming device according to claim 1, further comprising fixing members that fix the pair of side plates to the attachment edge of the bottom plate.

7. A method of assembling a bottom surface of an image forming device to a pair of side plates that support components used by the image forming device for image formation, comprising the steps of:

mutually aligning the pair of side plates with a jig; and fixing a bottom plate having a bottom surface to the pair of aligned side plates being attached to an attachment edge being bent from edges of the bottom surface, a pair of side plates being attached to the attachment edge of the bottom plate, the pair of side plates respectively supporting components of the image forming device used for image formation, the pair of side plates having a plurality of mounts fixed to at least one length of the peripheral edge.

8. A frame structure for an image forming device according to claim 4, wherein the peripheral edge is continuously formed around the entire periphery of the side surface.

9. A frame structure for an image forming device, comprising:

a bottom plate having a bottom surface;

an attachment edge being bent from the edges of the bottom surface, the attachment edge being continuously formed around the entire peripheral edge of the bottom surface; and a pair of side plates being attached to the attachment edge of the bottom plate, the pair of side plates respectively supporting components of the image forming device used for image formation, the pair of side plates having a plurality of mounts fixed to at least one length of the peripheral edge, the pair of side plates each having a side surface that supports components used by the image forming device for image formation, and a peripheral edge being drawn outward from the edge of the entire periphery of the side surface.

10. A frame structure for an image forming device according to claim 9, wherein the peripheral edge is continuously formed around the entire periphery of the side surface.

* * * * *